US006560906B1

(12) United States Patent
Hillstrom

(10) Patent No.: US 6,560,906 B1
(45) Date of Patent: May 13, 2003

(54) PORTABLE SIGN STAND HAVING FRANGIBLE POST

(75) Inventor: David U. Hillstrom, Novi, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 0 days.

(21) Appl. No.: 09/717,575

(22) Filed: Nov. 21, 2000

(51) Int. Cl.[7] ..... G09F 15/00

(52) U.S. Cl. ..... 40/606; 40/612; 52/98; 248/548; 248/900

(58) Field of Search ..... 40/606, 607, 612, 40/608; 52/98; 248/548, 900; 403/2; 404/10

(56) References Cited

U.S. PATENT DOCUMENTS

| | | | | | |
|---|---|---|---|---|---|
| 1,800,010 | A | | 4/1931 | Emerson | |
| 1,839,690 | A | | 1/1932 | Malinowski | |
| 1,883,467 | A | | 10/1932 | Banks | |
| 1,944,777 | A | | 1/1934 | Banks | |
| 2,048,388 | A | | 7/1936 | Johnsen | |
| 2,085,074 | A | | 6/1937 | Boyles | |
| 2,949,324 | A | | 8/1960 | Birge et al. | |
| 3,349,531 | A | | 10/1967 | Watson | |
| 3,499,630 | A | | 3/1970 | Dashio | |
| 3,951,556 | A | | 4/1976 | Strizki | |
| 4,071,970 | A | | 2/1978 | Strizki | |
| 4,137,662 | A | * | 2/1979 | Baumer | 40/612 |
| 4,288,053 | A | * | 9/1981 | Sarkisian | 40/607 X |
| 4,432,172 | A | * | 2/1984 | Kuykendall et al. | 52/98 |
| 4,490,062 | A | | 12/1984 | Chisholm | |
| 4,610,432 | A | * | 9/1986 | Lewis et al. | 52/98 X |
| 4,630,413 | A | * | 12/1986 | Svensson | 52/98 |
| 4,720,204 | A | | 1/1988 | Johnson | |
| 4,738,058 | A | * | 4/1988 | Svensson | 52/98 |
| 4,747,725 | A | | 5/1988 | Gebelius | |
| 4,926,592 | A | | 5/1990 | Nehis | |
| 5,094,023 | A | | 3/1992 | McVey | |
| 5,125,194 | A | | 6/1992 | Granger | |
| 5,214,886 | A | * | 6/1993 | Hugron | 52/98 |
| 5,480,121 | A | * | 1/1996 | Rice et al. | 52/98 X |
| 5,782,040 | A | | 7/1998 | McCartan | |
| 5,860,253 | A | | 1/1999 | Lapointe | |
| 5,957,425 | A | | 9/1999 | Conway et al. | |

* cited by examiner

*Primary Examiner*—Brian K. Green
(74) *Attorney, Agent, or Firm*—Harness, Dickey & Pierce, P.L.C.

(57) ABSTRACT

A portable signpost assembly having a portable base structure and a frangible support post coupled to the portable base structure. The frangible support post includes a plurality of corners, wherein at least one of the corners, when viewed in cross section, includes a notch formed therein that promotes localized fracturing of the frangible support post upon contact from a motor vehicle. This enables the frangible support post to be broken away from the portable base structure upon impact from an errant vehicle to permit the sign and support post to travel over the vehicle without entering the passenger compartment.

19 Claims, 2 Drawing Sheets

FIG 1
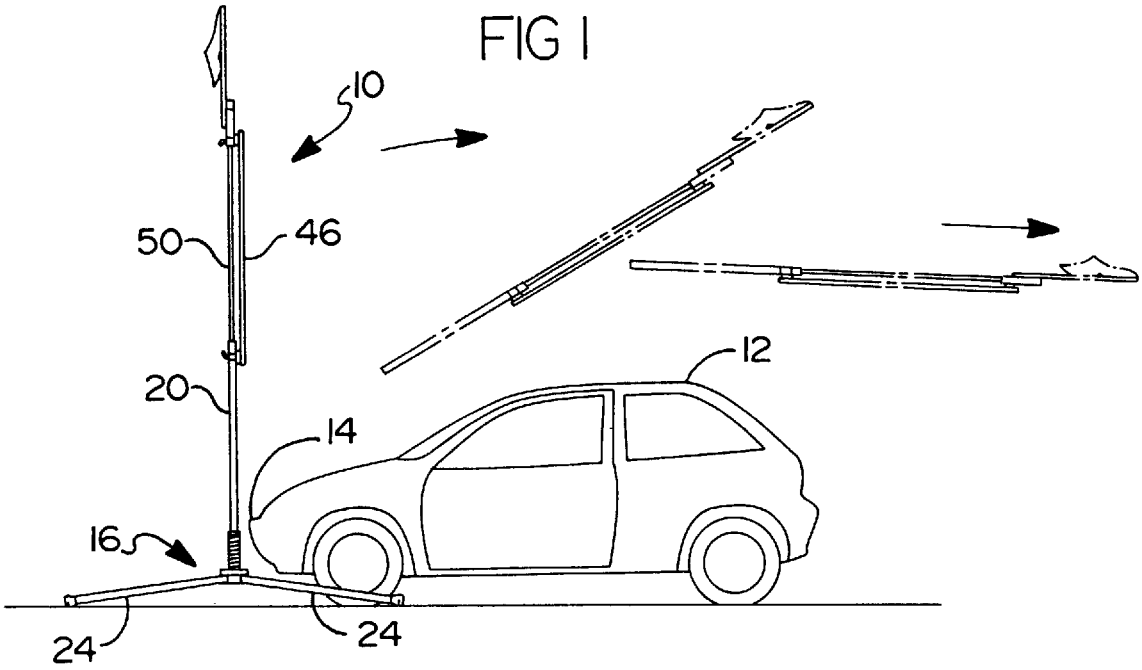
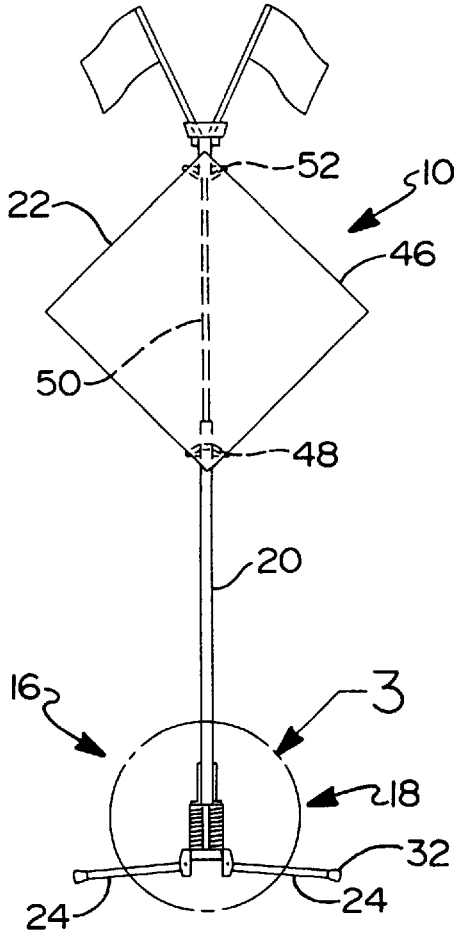
FIG 2

FIG 3
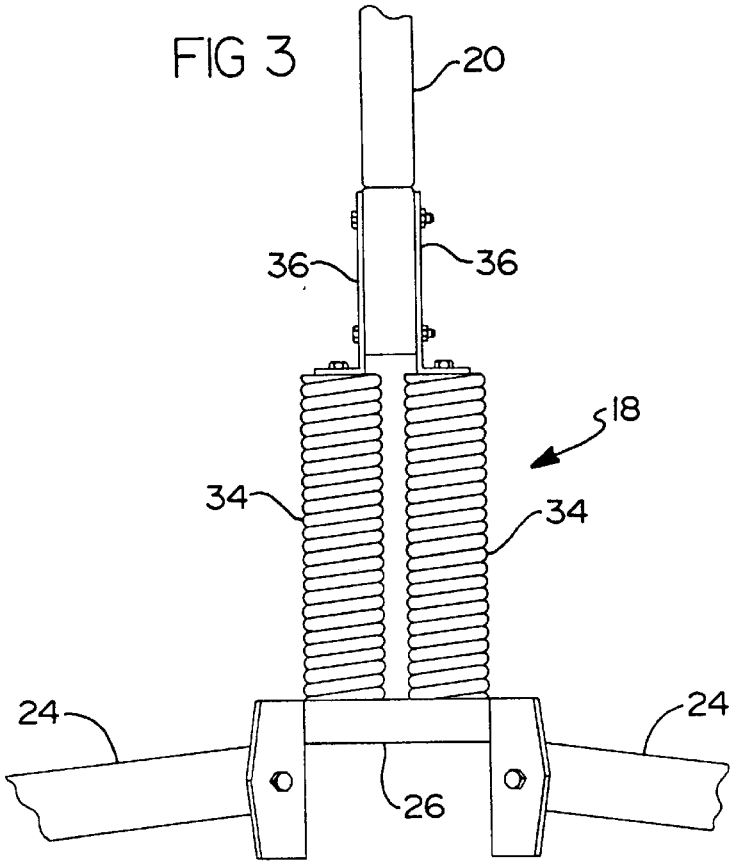
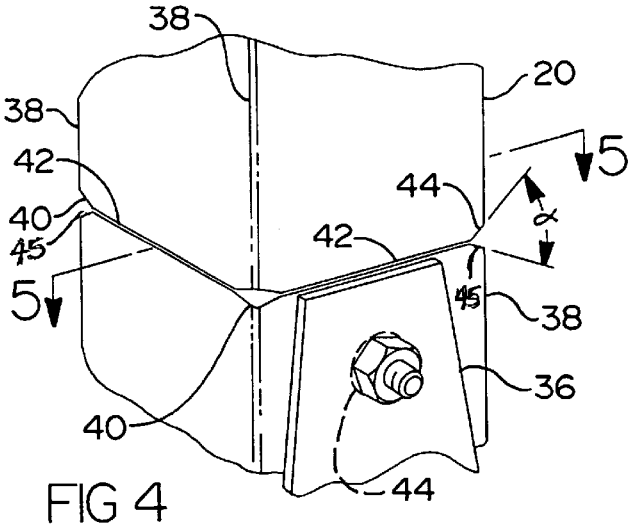
FIG 4
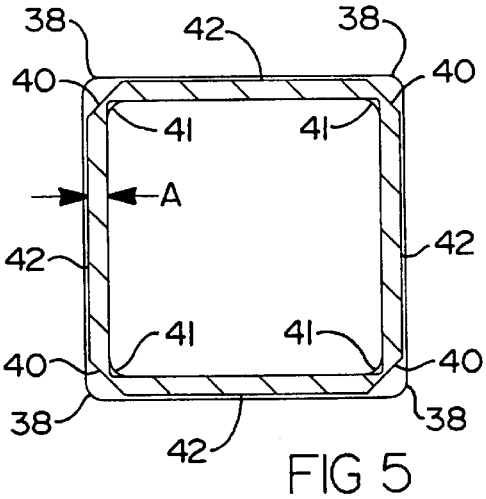
FIG 5

PORTABLE SIGN STAND HAVING FRANGIBLE POST

FIELD OF THE INVENTION

The present invention relates to portable sign assemblies and, more particularly, relates to a portable sign assembly having a frangible post to readily breakaway when impacted by an errant vehicle.

BACKGROUND OF THE INVENTION

Federal, state, and local governments require that signposts and other structures associated with road construction be of a type designed to ensure the safety of motorists in the event of a collision with the signposts or other structures. Specifically, the Federal Highway Administration (FHWA) sets standards and oversees the design and construction of traffic signposts on federal highways. Signposts must also conform to standards set by the National Cooperative Highway Research Program (NCHRP) and the American Association of State Highway Transportation Officials (AASHTO).

According to NCHRP Report 350 (hereinafter "NCHRP-350"), a goal of a highway safety feature, such as a sign, is to provide a forgiving roadway and roadside for an errant motorist. This safety goal is met when the highway feature readily breaks away, fractures, or yields without causing serious injuries to the occupant of the vehicle or to other motorists, pedestrians, or work zone personnel. Moreover, it is a goal that no portion of the sign assembly should enter the passenger compartment of the vehicle.

According to NCHRP-350, Tests 70 and 71 relate to the testing of Work Zone Traffic Control Devices. According to these tests, the work zone traffic control device is tested at various impact speeds—a low-speed test at approximately 35 km/h and a high-speed test at approximately 100 km/h. The low-speed test is generally intended to evaluate the breakaway, fracture, or yielding mechanism of the device whereas the high-speed test is intended to evaluate vehicular stability and test article trajectory. Occupant risk is of concern in both tests.

When applying these tests and standards to existing portable highway signs, it has been found that portable highway signs having generally rigid, metallic sign displays may not be thrown clear when impacted by an errant vehicle. That is, upon impact, conventional portable highway signs may be forced against the hood and/or roof of the vehicle rather than being thrown clear of the vehicle. This effect is particularly noticeable with portable highway signs having rigid, metallic sign displays. On the other hand, state departments of transportation and local highway construction companies own substantial numbers of rigid, metallic, and/or wood sign displays that are used in conjunction with fixed signs and portable signs. Many of these rigid, metallic, and wood signs are unique to various applications, such as merging, caution, and the like. As such, these rigid, metallic, and wood signs represent a significant investment made by these states and local highway construction companies over the course of many years. Current replacement of these rigid, metallic, and wood signs inventories with comparable flexible rollup sign displays is not financially feasible for many of these states and companies due to the cost of such flexible sign displays. Accordingly, there exists a need to provide a portable, breakaway highway sign and/or retrofit for use with existing rigid, metallic, and wood sign displays that complies with NCHRP-350.

As determined by these tests and usage experience, breakaway signposts have proven to be highly effective in reducing vehicle damage and occupant injury resulting from collision therewith. A variety of breakaway signpost constructions intended to meet safety requirements for highway installations have been used in the prior art for installation of permanent highway traffic signs.

Conventional breakaway connections are typically provided between a relatively short section of post (base post or ground post) that is permanently driven into the ground, and a longer section of post (support post) that extends upwardly above the ground from the base post and supports the sign. When the motor vehicle collides with the signpost or posts, the section of the signpost above the ground is typically sheared off (through the use of shearing bolts) or hinged over to allow the motor vehicle to continue on its path with minimum damage to the vehicle and without injury to its occupants.

One particular type of signpost that has been used extensively in the prior art comprises a pair of square shaped members that are coupled together through a collar member. The collar member includes a pair of holes which tend to weaken an area between the pair of square shaped members to provide a breakaway feature as shown in U.S. Pat. No. 5,782,040.

Another particular signpost that has been used extensively in the prior art comprises a generally circular post member having a flanged lower end that is bolted to a permanent support structure, such as a concrete base. The bolts used to fasten the circular upper support post to the base structure are typically sized to permit the shearing of these bolts upon contact from an errant vehicle as shown in U.S. Pat. No. 3,951,556.

However, both of the above prior art breakaway connections, which use various sections bolted together, suffer from similar disadvantages. For instance, these breakaway connections require multiple parts to be assembled. This leads to potential difficulties in assembly depending on the size and weight of the components. That is, in order to fasten an upper support post to the lower base structure using a plurality of fasteners, that person is required to extend multiple fasteners through the lower post section, hold the upper post section in proper orientation while positioning it over the fasteners without dislodging the fasteners and then secure the fasteners by placing and tightening washers and nuts on them, for example, all while holding the upper post section in proper upright alignment. Many times heavy equipment, such as a hoist, is used to support the upper section while the fasteners are installed and tightened to make the final connection.

It is important that signposts, irrespective of size, be capable of withstanding ambient wind loads normally encountered by highway sign installations. Experience has shown that signs supported by a single support post, especially, tend to flutter when subjected to wind loads and this fluttering action imposes torsion on the post and fasteners holding the post sections together. This torsional loading of conventional signposts and fastener systems leads to frequent failure of the fasteners and/or post. Similarly, conventional portable sign assemblies must withstand these ambient wind loads, yet must also withstand the rigors of being transported and handled.

Accordingly, there exists a need in the relevant art to provide a breakaway highway signpost that is capable of being manufactured and assembled in a simple and cost effective manner. Furthermore, there exists a need in the relevant art to provide a highway signpost that provides a breakaway feature to minimize damage and/or intrusion into the passenger compartment of an errant vehicle. Still further, there exists a need in the relevant art to provide a highway sign assembly that is portable between construction sites. Additionally, there exists a need in the relevant art to provide a breakaway signpost that can enable the current inventory of conventional rigid signs to be used in applications that meet the federal safety standards. Lastly, there exists a need in the relevant art to provide a highway signpost and assembly that overcomes the disadvantages of the prior art.

SUMMARY OF THE INVENTION

In accordance with the broad teachings of this invention, a portable signpost assembly having an advantageous construction is provided. The portable signpost assembly includes a portable base structure and a frangible support post coupled to the portable base structure. The frangible support post includes a plurality of corners when viewed in cross section, wherein at least one of the corners includes a notch formed therein that promotes localized fracturing of the frangible support post upon contact from a motor vehicle. This enables the frangible support post to be broken away from the portable base structure upon impact from an errant vehicle to permit the sign and support post to travel over the vehicle without entering the passenger compartment.

Further areas of applicability of the present invention will become apparent from the detailed description provided hereinafter. It should be understood that the detailed description and specific examples, while indicating preferred embodiments of the invention, are intended for purposes of illustration only.

BRIEF DESCRIPTION OF THE DRAWINGS

The present invention will become more fully understood from the detailed description and the accompanying drawings, wherein:

FIG. 1 is a side view of a portable signpost assembly according to the principles of the present invention as shown in relation to a motor vehicle showing in phantom the frangible support post and sign being thrown clear of the vehicle;

FIG. 2 is a front view of the portable signpost assembly;

FIG. 3 is an enlarged front view of the portable signpost assembly;

FIG. 4 is a perspective view of a portion of the frangible support post of the present invention; and FIG. 5 is a cross sectional view of the frangible post taken along line 5–5 in FIG. 4.

DETAILED DESCRIPTION OF THE PREFERRED EMBODIMENT

The following description of the preferred embodiment is merely exemplary in nature and is in no way intended to limit the invention, its application, or uses. For example, this description will be primarily directed to portable signpost assemblies; however, the principles of the present invention may equally be applied to non-portable signpost assemblies. Moreover, the present invention may find utility in conjunction with non-rigid sign displays, such as a roll-up type and the like. Likewise, the present invention may find utility in conduction with rigid sign displays being made of metal, wood, and/or plastic (i.e. extruded plastic panels having fluted internal reinforcements).

Referring to FIG. 1, a portable breakaway signpost assembly 10 is shown in relation to an errant vehicle 12. For purposes of this discussion, errant vehicle 12 is a compact type vehicle having a front bumper 14 generally centered approximately 16–24 inches above ground level. It should be understood, however, that the benefits and advantages of the present invention might be realized by vehicle designs other than that depicted in the included drawings.

Portable signpost assembly 10 includes a base assembly 16; a spring assembly 18; an upright, frangible support post 20; and a rigid sign display 22. As described more fully herein, frangible support post 20 is designed to breakaway or fail when errant vehicle 12 collides with portable signpost assembly 10, thereby separating the upper section of frangible support post 20 and rigid sign display 22 from base assembly 16 and spring assembly 18. This separation enables rigid sign display 22 to be thrown clear from errant vehicle 12 (FIG. 1), thereby preventing incursion into the passenger compartment of errant vehicle 12. In addition, frangible support post 20 is designed to withstand ambient wind loads without failure.

In the interest of brevity, portable signpost assembly 10 of the present invention will be described as it is embodied in portable sign model no. 4860, which is available from the assignee of the present application. The 4860 model is a portable signpost assembly having a 48"×48"×0.080" rigid aluminum sign positioned approximately 60" above ground when measured to the bottom of the rigid aluminum sign. The 4860 model further includes a 1.50"×1.50"×0.10" 6061-T6 aluminum alloy frangible support post. Alternatively, the 4860 model may include a 1.50"×1.50"×0.06", hot rolled, 16 gauge steel frangible support post. However, it should be appreciated that the teaching of the present invention may be applied to signpost assemblies having differing dimensions and may be constructed out of different materials. Moreover, it should be appreciated that the teachings of the present invention may be used in conjunction with rigid sign displays being made of various rigid materials, such as aluminum, wood, plastic, and the like.

As best seen in FIGS. 2 and 3, base assembly 16 includes a set of four outwardly extending support legs 24. Each of the outwardly extending support legs 24 is pivotally coupled to a steel base member 26 via a fastener, such as a bolt. Preferably, each support leg 24 is made of 1.25"×1.25"×0.10" 6061-T6 aluminum alloy. Each outwardly extending support leg 24 further includes a molded rubber leg cap 32

(FIG. 2) riveted to an end thereof to prevent slippage of breakaway portable signpost assembly 10 relative to the ground.

As best seen in FIG. 2, breakaway portable signpost assembly 10 further includes rigid sign display 22. Rigid sign display 22 includes a rigid sign 46 that is mounted at the bottom thereof to frangible support post 20 via a lower bracket 48. A top portion of rigid sign 46 is mounted to a telescoping support post 50, which is slidably disposed in frangible support post 20, via an upper bracket 52. Telescoping support post 50, frangible support post 20, upper bracket 52, and lower bracket 48 cooperate to support and retain rigid sign 46 thereon for display purposes to motor vehicle traffic. As is common, additional caution flags and/or flashing lights may be attached either to the upper end of telescoping support post 50 or to rigid sign 46 directly.

As best seen in FIG. 3, spring assembly 18 includes a pair of coil springs 34 that are each mounted at one end to base member 26 of base assembly 16 via a mounting bracket and/or fasteners. Spring assembly 18 further includes a pair of L-shaped brackets 36 attached to an opposing end of each coil spring 34. L-shaped brackets 36 are aligned on either side of frangible support post 20 and secured thereto with a plurality of fasteners that extend through L-shaped brackets 36 and frangible support post 20. It should be noted that L-shaped brackets 36 could be formed integrally with frangible support post 20. Alternatively, a mounting flange may be permanently attached to frangible support post 20, such as by welding, to facilitate assembly of breakaway signpost assembly 10.

Frangible support post 20 is preferably of aluminum alloy construction. Specifically, frangible support post 20 is a 6061-T6-aluminum alloy. As best seen in FIGS. 4 and 5, frangible support post 20 generally includes a plurality of corners 38 when viewed in cross-section. More particularly, frangible support post 20 is preferably square shaped to provide overall rigidity against torsion and lateral loading. As best seen in FIG. 4, frangible support post 20 is tubular or hollow, thereby defining a uniform wall thickness A.

Frangible support post 20 further includes at least one notch 40 formed in one of the plurality of corners 38. However, NCHRP-350 requires that highway signs satisfy the federal safety standard when impacted from the front and side. Therefore, it is preferred that notch 40 is formed in each corner 38. This arrangement enables the fracture characteristics of frangible support post 20 to be the same when impacted from any direction.

Notch 40 is formed by either removing material or deforming material at corner 38. The removal of material may be accomplished by sawing, punching, or otherwise cutting corner 38 to a predetermined depth in accordance with the desired fracturing characteristics. Alternatively, the deformation of corner 38 to form notch 40 may be accomplished by cold forming, progressive dies, chiseling, or the like. When notch 40 is formed in corner 38 through deformation, material is not removed but rather is "pushed" to one or more sides to result in a reduced wall thickness section at notch 40. As a byproduct of the deformation method, some wall material may be forced inwardly within frangible support post 20, as shown in phantom generally as 41. In essence, this inwardly projecting material 41 within frangible support-post 20 tends to add additional strength to frangible support post 20 since additional material remains along the backside of the deformation. In other words, comparing the deformation method to the cutting method, if a notch of uniform depth is provided, then an incremental amount of additional material is present in the deformed version as a byproduct of the deformation process. This additional material within the support post adds strength relative to the cutting method, However, it is anticipated that either method may be employed in forming the notches in frangible support post 20 depending upon the preferred fracturing characteristics required in the particular sign application.

As best seen in FIG. 4, notch 40 is preferably formed into a wedge shape such that it includes a pair of converging surfaces 44, 45 that terminate into a point or line. Accordingly, this shape provides an area of stress concentration. Preferably, converging surfaces 44, 45 define an angle $\alpha$ of approximately 30°. However, it should be understood that the specific profile of notch 40, including the angle of any converging surfaces, is dependent on the preferred fracturing characteristics. Therefore, it should further be understood that notch shapes not specifically recited within this application are intended to be included within its teachings. For example, the notch shape may be rectangular or square when viewed in cross section. Alternatively, the notch shape may be semi-circular. That is, any shape may be used which promotes a concentration of stresses generally at the notch location to facilitate fracturing.

Still referring to FIG. 4, preferably each notch 40 is further interconnected by a scoring mark 42. Scoring mark 42 is a line formed between adjacent notches 40 during or separate from the deformation or cutting process. Scoring marks 42 help to promote fracturing along a predictable path—between adjacent notches along scoring mark 42. This helps to facilitate fracturing of frangible support post 20 in a known manner. The ability to promote fracturing along a predictable path is particularly useful when structural features, such as apertures formed in support post 20 (generally indicated at 44), are positioned generally adjacent to notch 40. Score marks 42 function to direct the fracturing along the score mark rather than allowing the fracturing to progress toward aperture 44. Thus, score marks 42 promote a predictable fracturing path and, thus, promote predictable fracturing characteristics. It should be appreciated that scoring marks 42 are optional depending upon the fracturing characteristic of the support post. In some cases, fracturing between notch 40 and aperture 44 is an acceptable fracture path, so long as support post 20 is able to withstand wind loading while readily breaking away upon impact from an errant vehicle.

The particular depth and location of notches 40 and score marks 42 is particularly dependent upon the necessary fracturing characteristics required. Road sign applications having differing heights, sign weights, and materials may require variations in the notch depth and scoring mark configuration. Accordingly, it has been found that notch depths as small as approximately ⅛ of wall thickness A provide adequate concentration of stress to facilitate a breakaway function. On the other hand, it has also been found that notch depths that extend entirely through corner 38 may likewise be used. Most preferably, in connection with a 48"×48"×0.080" rigid aluminum sign positioned approximately 60" above ground, it has been found that a notched depth of approximately ⅔ of wall thickness A will promote the preferred fracturing characteristics for these signs. With regard to scoring marks 42, these marks should be deep enough to prevent unwanted fracturing along unknown paths. It has been found that a score mark 42 depth of approximately 15–20% of wall thickness A provides suitable fracturing control with the 1.50"×1.50"×0.10" aluminum frangible support post.

During operation, errant vehicle 12 impacts frangible support post 20 of signpost assembly 10 from any direction such that front bumper 14 of errant vehicle 12 is generally at the same height above the ground as notches 40. As the impact force is transmitted to frangible support post 20, material stress concentrations occur within notch 40 which exceed the ultimate tensile strength of the material in the region of notch 40. As the stress concentration exceeds the ultimate tensile strength of the material, plastic deformation occurs, thereby leading to crack propagation along score marks 42. The failure of frangible support post 20 in this manner enables the failure properties (e.g. load required to break frangible support post 20) to be designed for and predicted without the need for complicated and multi-piece breakaway connections. The quick fracturing of frangible support post 20 enables support post 20 and rigid sign display 22 to be thrown upward and away from errant vehicle 12 as shown in phantom in FIG. 1.

It should be appreciated from the above discussion that frangible support post 20 of the present invention provides a simple and convenient alternative to the complicated and cumbersome prior art methods of producing a breakaway signpost feature. That is, the present invention provides a single, unitary tubular member that does not require additional fasteners, joints, or assembly. The support post of the present invention may be formed in mass and may be assembled by a single worker. It is also important to note that frangible support post 20 of the present invention may be used as a retrofit device in existing roadway sign applications. That is, frangible support post 20 may be mounted to existing base assemblies and/or rigid sign assemblies to provide a breakaway feature in conventional rigid sign applications. This is particularly useful and cost effective for states and companies having large inventories of signs that would not otherwise pass federal standards.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A portable apparatus for supporting a safety sign, said apparatus comprising:

a portable base structure; and an upright hollow support post coupled to said portable base structure, said support post having a plurality of corners, said upright hollow support post defining an outer surface and an opposing inner surface;

a first notch formed on said outer surface at a first of said plurality of corners;

a second notch formed on said outer surface at a second of said plurality of corners; and a score line extending generally horizontally between said first notch and said second notch, said notches and said score line together promoting fracturing of said support post upon contact from a motor vehicle to enable said support post to be broken away from said portable base structure to prevent damage to the motor vehicle.

2. The portable apparatus according to claim 1, further comprising;

a third notch formed on said outer surface at a third of said plurality of corners; and a fourth notch formed on said outer surface at a fourth of said plurality of corners.

3. The portable apparatus according to claim 1 wherein said hollow support post defines a wall thickness, a depth of said score line being generally in the range of about 15–20% of said wall thickness.

4. The portable apparatus according to claim 1 wherein said hollow support post defines a wall thickness, a depth of at least one of said first notch and said second notch being generally greater than or equal to about ⅛ of said wall thickness.

5. The portable apparatus according to claim 1 wherein said hollow support post defines a corner wall thickness, a depth of at least one of said first notch and said second notch being generally in the range of about 10–100% of said corner wall thickness.

6. The portable apparatus according to claim 1 wherein said height of said score line is generally about 16" to 24" above a ground level.

7. A safety sign comprising:

a base;

a tubular support post having a plurality of corners, said upright hollow support post defining an outer surface and an opposing inner surface;

a first notch formed on said outer surface at a first of said plurality of corners;

a second notch formed on said outer surface at a second of said plurality of corners; and a biasing member interconnecting said single support post to said base to enable a predetermined amount of pivotal movement;

a sign being mounted to said tubular support post; and a score line extending generally horizontally between said first notch and said second notch, said notches and said score line together promoting fracturing of said tubular support post along said score line upon contact from a motor vehicle to enable said tubular support post to separate from said base to prevent damage to the motor vehicle.

8. The safety sign according to claim 7, further comprising;

a third notch formed on said outer surface at a third of said plurality of corners; and a fourth notch formed on said outer surface at a fourth of said plurality of corners.

9. The safety sign according to claim 7 wherein said tubular support post defines a wall thickness, a depth of said score line being generally in the range of about 15–20% of said wall thickness.

10. The safety sign according to claim 7 wherein said tubular support post defines a wall thickness, a depth of at least one of said first notch and said second notch being generally greater than or equal to about ⅛ of said wall thickness.

11. The safety sign according to claim 7 wherein said tubular support post defines a corner wall thickness, a depth of at least one of said first notch and said second notch being generally in the range of about 10–100% of said corner wall thickness.

12. The safety sign according to claim 7 wherein said height of said score line is generally about 16" to 24" above a ground level.

13. The safety sign according to claim 7, wherein said sign is a rigid type sign.

14. A portable safety sign comprising:

a base having a plurality of outwardly extending legs;

a hollow support post having a plurality of corners when viewed in cross section and defining a wall thickness between an inner surface thereof and an outer surface thereof, each of said corners having a notch extending through a portion of said outer surface;

a generally horizontally extending score line interconnecting at least some of said notches, said notches and said score line together promoting fracturing of said hollow support post along said generally horizontally extending score line upon contact from a motor vehicle to enable said tubular support post to separate from said base to prevent damage to the motor vehicle;

a spring member operably coupling said hollow support post to said base; and a sign being mounted to said hollow support post.

15. The portable safety sign according to claim 14 wherein each of said notches promotes localized fracturing of said hollow support post upon contact from a motor vehicle.

16. The portable safety sign according to claim 14 wherein said hollow support post defines a wall thickness, a depth of said score line being generally in the range of about 15–20% of said wall thickness.

17. The portable safety sign according to claim 14 wherein a depth of said notches being generally greater than or equal to about ⅛ of said wall thickness.

18. The portable safety sign according to claim 14 wherein said hollow support post defines a corner wall thickness, a depth of said notches being generally in the range of about 10–100% of said corner wall thickness.

19. The portable safety sign according to claim 18 wherein said height of said notches is generally about 16" to 24" above a ground level.

* * * * *

UNITED STATES PATENT AND TRADEMARK OFFICE

CERTIFICATE OF CORRECTION

PATENT NO. : 6,560,906 B1 
DATED : May 21, 2003
INVENTOR(S) : David U. Hillstrom It is certified that error appears in the above-identified patent and that said Letters Patent is hereby corrected as shown below:

Column 4,
Line 13, “conduction” should be -- conjuction --;

Column 6,
Line 1, “support-post” should be -- support post --;
Line 9, “method,” should be -- method. --;

Column 10,
Line 21, “claim 18” should be -- claim 14 --.

Signed and Sealed this

Thirtieth Day of September, 2003

JAMES E. ROGAN
*Director of the United States Patent and Trademark Office*